United States Patent [19]

de Nevers

[11] 4,443,332

[45] Apr. 17, 1984

[54] CROSS FLOW SOLID-TO-SOLID HEAT TRANSFER APPARATUS

[75] Inventor: Noel H. de Nevers, Salt Lake City, Utah

[73] Assignee: Oros Company, Salt Lake City, Utah

[21] Appl. No.: 400,913

[22] Filed: Jul. 22, 1982

Related U.S. Application Data

[62] Division of Ser. No. 167,794, Jul. 14, 1980.

[51] Int. Cl.[3] ..... B07B 1/36

[52] U.S. Cl. ..... 209/331; 165/84; 165/109 R; 209/2; 209/11; 209/238; 209/333; 209/341

[58] Field of Search ..... 209/2, 11, 238, 240, 209/244, 309, 341, 331–333; 165/1, 84, 86, 88, 109 R, 111, 119; 432/239; 366/111, 114, 187; 261/17; 266/259, 260; 222/145, 200

[56] References Cited

U.S. PATENT DOCUMENTS

| | | | |
|---|---|---|---|
| 45,517 | 12/1864 | Patterson | 209/333 X |
| 1,976,180 | 10/1934 | Marot | 209/244 X |
| 2,136,870 | 11/1938 | Vissac | 209/238 X |
| 2,592,783 | 4/1952 | Aspegren | 165/88 X |
| 3,209,911 | 10/1965 | Speno et al. | 209/244 X |
| 4,038,021 | 7/1977 | Benson | 165/88 X |
| 4,182,400 | 1/1980 | de Nevers | 165/84 X |
| 4,207,943 | 6/1980 | Gardner et al. | 209/285 X |
| 4,220,526 | 9/1980 | Armstrong et al. | 209/240 |

*Primary Examiner*—Richard L. Chiesa

*Attorney, Agent, or Firm*—Thorpe, North & Western

[57] ABSTRACT

Apparatus for transferring heat between solid particles includes placing a first granular material composed of particles of a first size on the upper side of a downwardly sloping vibratory screen. The openings in the screen are sufficiently small to prevent passage therethrough of the particles of the first material. A second granular material composed of particles of a second size, smaller than the first size, is spread over the first material on the screen to mix with and sift through the first material as the screen is vibrated. The size of the particles of the second material is small enough to allow passage through the openings in the screen. The first and second materials are at different temperatures so that as the particles of the two materials mix, heat is transferred between the particles. After mixing and heat transfer, the first material flows off the lower edge of the screen where it can be gathered, and the second material flows through the screen where it likewise can be gathered.

4 Claims, 2 Drawing Figures

CROSS FLOW SOLID-TO-SOLID HEAT TRANSFER APPARATUS

This application is a division of application Ser. No. 167,794, filed July 14, 1980.

BACKGROUND OF THE INVENTION

This invention relates to an apparatus for crossflow and mixing of solids which are at a different temperature to facilitate transfer of heat between the solids.

A common and recurring industrial need is that of transferring heat to or removing heat from materials for the purpose of, for example, preparing such materials for processing operations which are to be carried out at certain temperatures. After the processing, it is oftentimes desirable to bring the temperature of the material back to its previous temperature for stroage, packaging, etc.

Heat transfer or exchange between fluids is oftentimes accomplished by the well known process of placing two fluids of differing temperature in as close proximity as possible with each other, One of the simplest ways of doing this is to place a small pipe inside a larger pipe and then apply one fluid to the small pipe and the other fluid to the larger pipe (outside the smaller pipe). If the two fluids are applied to the pipe so that they both flow in the same direction (parallel flow), then the temperatures of the two fluids tend toward the average therebetween. If the fluids are applied to the pipes to flow in opposite directions (counterflow), then the temperature of each fluid tends toward the other fluid's entering temperature.

There have been a number of suggestions for providing heat exchange between solid materials including those disclosed in U.S. Pat. Nos. 2,592,783, 4,038,021, 4,182,400 and 4,207,943. In the first mentioned patent, heated or cooled balls are brought into direct contact with a material to be either heated or cooled inside a rotating drum. The balls are piled up in one end of the rotating drum and the material in the other end and the rotation of the drum tends to move the balls and material towards one another in a type of counterflow operation to somehow mix so that heat can be exchanged between the balls and the material.

The structure disclosed in the second mentioned patent includes an inclined tubular casing and an auger disposed within the casing, with the flights of the auger being perforated. A granular product to be dried, and heat conducting particles such as salt, are discharged into the casing from an opening in the bottom end of a tubular shaft of the auger. As the auger is rotated, the granular product and heat conducting particles are in some manner intermixed, with the granular product being forced upwardly in the casing since the product is of a size too large to pass through the holes in the auger flights, and the heat conducting particles apparently staying near the bottom of the casing since the particles are small enough to pass through the holes in the auger flights.

In the third mentioned patent, a counter-current heat transfer device is shown to include an inclined, rotatable, cylindrical drum in which is disposed a helical auger whose outer lip is maintained in contact with the interior wall of the drum. The auger includes a plurality of openings so that when a fine material is introduced into the upper end of the drum and a coarse material is introduced into the lower end of the drum, and the drum is rotated, the fine material sifts through the auger and the coarse material is carried by the auger to the upper end of the drum. In this manner, the coarse and fine material contact one another to exchange heat.

The fourth mentioned patent discloses a rotatable cylindrical drum which includes plates mounted on the interior surface thereof, and an elongate vibratory screen disposed within the drum but supported independently thereof. Vanes are located underneath the screen to guide material falling from the screen toward one end of the drum. A first granular material is introduced onto the screen at said one end of the drum, with the particles of this granular material being of a size greater than the size of the openings in the screen. A second granular material is introduced into the other end of the drum with the particle size of this material being less than the size of the screen openings. When the drum is rotated, the second granular material is carried from the bottom of the drum toward the top thereof where it then falls from the blades onto the screen. As the screen is vibrated, the first granular material is caused to move downwardly on the screen to contact the second material, and the second material is caused to sift through the apertures in the screen to be carried by the blades back up onto the screen. Heat transfer can thus take place between the first and second materials.

All of the above arrangements appear to provide for heat exchange between solids, but all are fairly complicated, requiring sophisticated equipment to implement.

SUMMARY OF THE INVENTION

It is an object of the present invention to provide a new, improved and simple to implement method and apparatus for enabling exchange of heat between solids.

It is another object of the invention to provide an efficient and reliable apparatus and method for enabling exchange of heat between solid particles in a type of mixing or crossflow operation.

It is a further object of the invention to provide such a method and apparauts in which gravity is utilized to place the solids into contact with one another for heat exchange purposes and to thereafter separate the solids.

The above and other objects of the invention are realized in a specific illustrative embodiment thereof which includes a separator formed with a plurality of apertures therein and oriented to be generally horizontal or at an acute angle with respect to the horizontal, a bin or other guide structure for introducing a first granular material onto the separator near one edge thereof, and another bin or guide structure for introducing a second granular material onto the first granular material. Apparatus is also provided for causing the separator to vibrate. The first granular material is of a size generally larger than the apertures in the separator whereas the second granular material is of a size generally smaller than the size of such apertures. As the separator is vibrated, the second granular material sifts through the first granular material to the separator and then through the apertures in the separator, and the first granular material moves gradually toward the side of the separator opposite that side from which the material is introduced. In this manner, the first and second granular materials are placed in contact with one another to allow heat exchange to occur between the materials.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
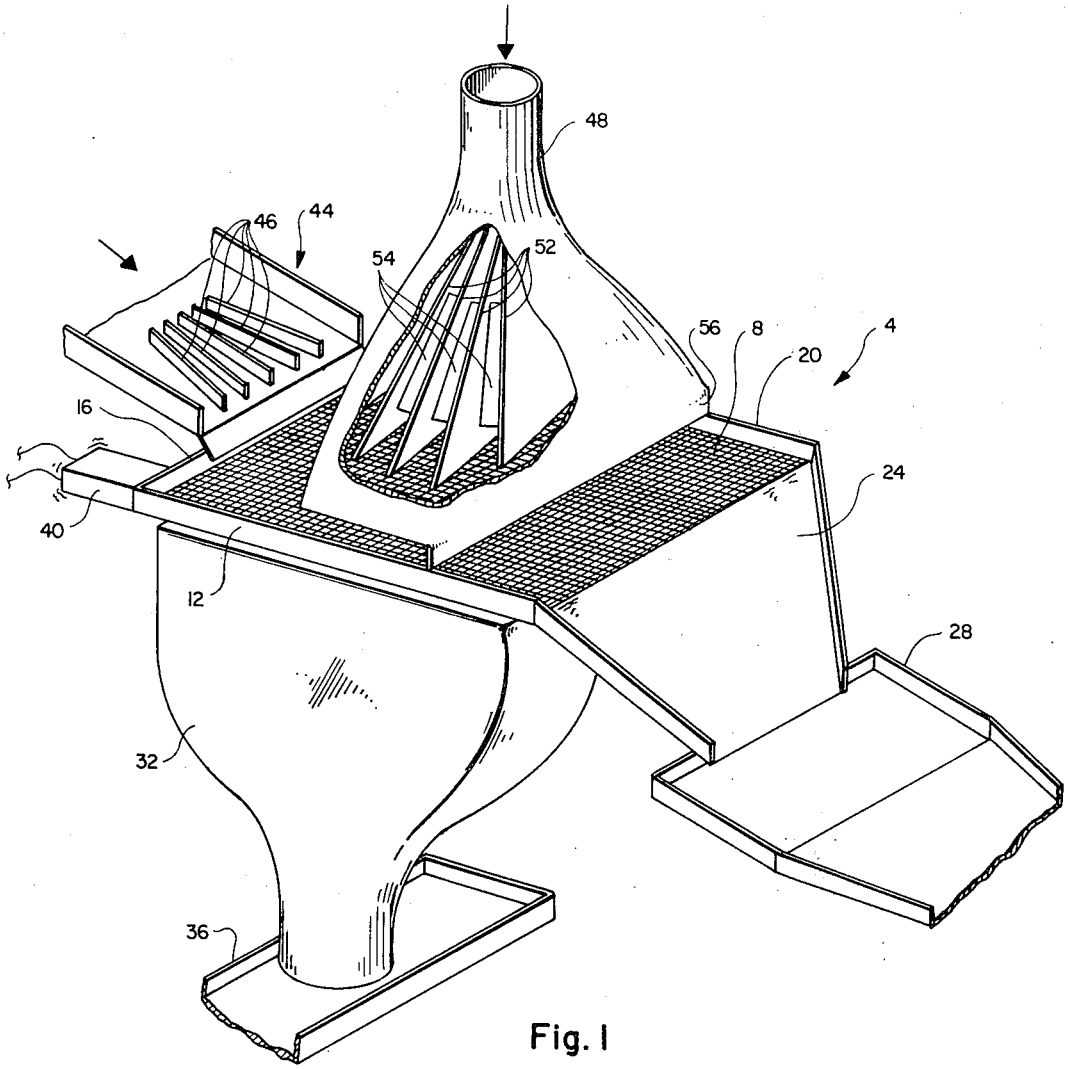
FIG. 1 is a perspective, partially cut away view of apparatus made in accordance with the present invention.

Referring to FIG. 1, there is shown a solid material separator 4 having a generally planar bottom wall screen 8 and side panels 12, 16 and 20 formed on three sides of the screen. The screen 8 includes a plurality of apertures or openings of a predetermined generally uniform size. Attached to the side of the screen 8 having no side panel is a down spout or discharge chute 24 for guiding any material flowing from the screen to another chute 28 which carries the material to the next processing step. The separator 4 is inclined with respect to the horizontal, with the side of the separator at which side panel 16 is located being elevated and the opposite side of the separator to which the discharge chute 24 is attached being lowered. Thus, the screen 8 slopes downwardly from the side panel 16 toward the discharge chute 24.

Disposed below the separator 4 for collecting and guiding materials passing through the openings in the screen 8 is a funnel 32 of conventional design. The funnel simply receives material which passes through the screen 8 and guides it towards another chute 36 which carries the material to another processing step. The funnel 32 could either be attached to the bottom of the separator 4 or supported independently thereof.

Mounted on one side of the separator 4 is a conventional vibrator 40. The vibrator 40 is electrically (could be mechanically) operated to agitate or vibrate the separator 4 generally in the direction of slope of the screen 8. The reason for this vibration will be discussed momentarily.

Mounted near the upper edge of the separator 4 is a feed bin or chute 44. The lower end of the chute 44 is positioned so that material introduced into the chute is fed onto the upper side of the screen 8. Ribs or guides 46 are upstanding from a bottom wall of the chute 44 to extend generally in the direction of flow of material introduced into the chute and are spaced to flair apart toward the lower end of the chute. The guides 46 serve to spread material laterally as it moves down the chute 44. The chute 44 is provided for supplying to the separator 4 a first granular material composed of particles of a size generally larger than the size of the openings in the screen 8.

Another bin or chute 48 is positioned above the separator 4 so that material introduced into the upper end of the chute is discharged through the lower end thereof onto the screen 8. The lower end of the chute 48 flairs outwardly as shown in the drawing. Disposed within the chute 48 are a first set of vanes 52 which are positioned generally vertically but with the lower ends thereof being separated by a greater distance than the upper ends. The lower edges of the vanes 52 are generally parallel with the side panel 16. Such orientation of the vanes 52 serves to spread out and distribute uniformly over a larger area of the screen 8 any material introduced into the upper end of the chute 48. The spreading occurs along the direction of flow of material. A second set of vanes 54 are positioned between the vanes 52 and generally perpendicularly therewith and are separated a greater distance at the lower ends thereof than at the upper ends. The vanes 54 serve to spread material introduced into the chute 48 laterally onto the separator 4.

Extending downwardly from one side of the chute 48 is a plate or barrier 56. The barrier 56 extends across the width of the separator 4 at a location above the side panels 12 and 20. The function of this barrier will be discussed later.

In operation, a first granular material having a certain temperature and composed of particles of a size generally larger than the size of the openings in the screen 8 is introduced through chute 44 onto the screen. The separator 4 is agitated by the vibrator 40 and this, together with the spreading effect of the guides 46, causes the material to spread out over the entire width of the screen 8. After such material has spread out to the extent indicated, but before it has moved close to the discharge chute 24, a second granular material having a temperature different from the temperature of the first granular material and having particles of a size generally smaller than the size of the screen perforations is introduced into the chute 48. This second material is spread and distributed by the vanes 52 and 54 onto the first material which is lying on the screen 8. As the separator 4 is agitated, the particles of the second material sift through the first material and when they reach the screen 8 they pass therethrough into the funnel 32 and onto the chute 36. The particles of the first material, being too large to pass through the screen openings, move along the downslope of the separator 4 and then out the discharge chute 24. The barrier 56 serves to further spread the second material over the first material. This is accomplished by the barrier 56 simply contacting and preventing movement of any of the second material which is at an elevation above the bottom edge of the barrier. Alternatively, the chute 48, without the barrier 56, could be disposed just above the separator 4 so that the rear wall of the chute itself would act as the barrier.

With the above-described operation, the second material travels in a type of crossflow movement to the travel of the first material so that the materials are in intimate contact to allow transfer or exchange of heat between the materials.

Figure 2:
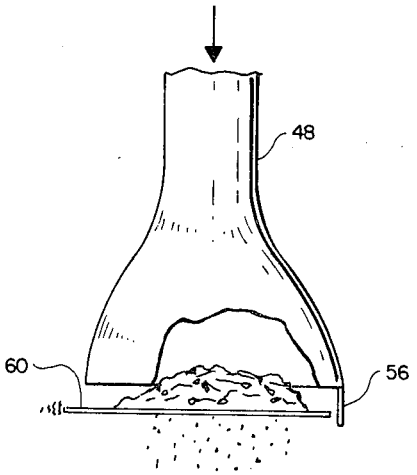
FIG. 2 is a side, elevational, partially cut-away view of another embodiment of the invention shown in FIG. 1.

FIG. 2 shows a side, elevational, partially cut away view of the chute 48 of FIG. 1 without the vanes 52 or 54. In place of the vanes is a second perforated screen or strainer 60 which is positioned just below the chute 48. The screen 60 may either be mounted to the separator 4 to vibrate therewith or it may be arranged to be vibrated independently. In either case, the screen 60 is caused to vibrate as illustrated graphically in FIG. 2. The size of the perforations of the screen 60 are generally large enough to allow the second material, discussed above, to pass therethrough. Thus, when the second material is introduced into the upper end of the chute 48, it falls onto the screen 60 which, because of vibration, spreads the material out more uniformly before it sifts through the screen onto the separator 4. Thus, a more uniform distribution of the second material onto the first material is achieved and as a result more intimate contact is had between the first and second materials.

Although specific structures have been described whereby first and second materials of different temperatures may be mixed together and then separated, the purposes of the present invention can be generally fulfilled by first mixing together materials of different temperatures and then maintaining the materials in contact with one another until the temperatures between the two are generally at equilibrium. The materials may then be separated, such as by using a separator similar to that disclosed and described above, for further use as desired. The structures described above allow for a type of crossflow mixing of the two materials and, as is evident, this provides a simple and yet effective method for achieving the exchange of heat between solids.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. Crossflow heat exchange apparatus comprising:

a generally planar separator means formed with a plurality of apertures therein and oriented generally at an acute angle with the horizontal;

first means for introducing onto said separator means a first granular material whose particles being of a certain temperature are generally of a size too large to pass through said apertures, said first means including means for spreading said first material uniformly over the upper side of the separator means;

second means for introducing onto and distributing and spreading over the first material on the separator means a second granular material whose particles being of a temperature different from said certain temperature are generally of a size small enough to enable passage thereof through said apertures, wherein said second introducing means comprises a chute, a lower end of which is positioned over the separator means, and a rear side of which forms a barrier means which extends generally crosswise of the slope of the separator means to inhibit movement of the second material along the downward slope of the separator means; and vibrator means coupled to said separator means for agitating the separator means so that the first material is caused to move toward the lower side of the separator means and the second material is caused to sift through the first material and through the apertures, the first and second granular materials thereby contacting one another to allow transfer of heat therebetween.

2. Apparatus as in claim 1 wherein said second introducing means is positioned to introduce the second material onto the first material near the upper side of the separator means.

3. Apparatus as in claim 1 wherein said spreading and distributing means comprises a first plurality of elongate vanes disposed at the lower end of the chute and positioned generally vertically, with the lower ends thereof flaring apart, and a second plurality of elongate vanes disposed generally vertically between the vanes of the first plurality to be generally perpendicular therewith, with the lower ends of the second plurality flaring apart.

4. Apparatus as in claim 1 wherein said second introducing means comprises a chute, a lower end of which is positioned over the separator means, and wherein said spreading and distributing means comprises a strainer means disposed above the separator means for intercepting said second material as it passes through the chute, said strainer means including apertures of sufficient size to allow the particles of the second material to pass therethrough.

* * * * *